US007314055B2

(12) United States Patent
Guo et al.

(10) Patent No.: US 7,314,055 B2
(45) Date of Patent: Jan. 1, 2008

(54) COVERED STRUCTURE WITH AN EXPANDABLE/CLOSEABLE EXTERIOR

(75) Inventors: Huali Guo, Linhai (CN); Huhua Zhou, Linhai (CN)

(73) Assignee: Yotrio Group Co., Ltd. (CN)

( * ) Notice: Subject to any disclaimer, the term of this patent is extended or adjusted under 35 U.S.C. 154(b) by 264 days.

(21) Appl. No.: 11/240,119

(22) Filed: Sep. 30, 2005

(65) Prior Publication Data

US 2006/0185704 A1 Aug. 24, 2006

(30) Foreign Application Priority Data

Feb. 24, 2005 (CN) ..... 2005 2 0039768 U

(51) Int. Cl.

| | |
|---|---|
| ***E04H 15/42*** | (2006.01) |
| ***E04H 15/28*** | (2006.01) |
| ***E04H 15/02*** | (2006.01) |
| ***A45B 23/00*** | (2006.01) |
| ***A45B 11/00*** | (2006.01) |

(52) U.S. Cl. ..... 135/156; 135/96; 135/16; 135/20.3; 135/98

(58) Field of Classification Search ..... 135/20.3, 135/121, 135, 156, 159, 16, 905; 52/79.5, 52/82, 83; 242/395; 248/345; 254/334, 254/335, 336, 338

See application file for complete search history.

(56) References Cited

U.S. PATENT DOCUMENTS

| | | | | |
|---|---|---|---|---|
| 1,900,274 | A * | 3/1933 | Brockie | 135/147 |
| 4,422,468 | A * | 12/1983 | Wilson | 135/97 |
| 6,761,181 | B1 * | 7/2004 | Tseng | 135/133 |
| 6,988,504 | B1 * | 1/2006 | Goldwitz | 135/20.1 |
| 7,111,633 | B2 * | 9/2006 | Moroney | 135/98 |

* cited by examiner

*Primary Examiner*—David Dunn
*Assistant Examiner*—Danielle Jackson
(74) *Attorney, Agent, or Firm*—DLA Piper US LLP; R. Blake Johnston, Esq.

(57) ABSTRACT

A structure with a retractable cover, for example, a gazebo with a hanging umbrella, where the retractable cover is connected by a pull cord to a winding device, wherein operation of the winding device allows the user to open or retract the cover. If the structure will not be used for a long period, or if there is strong wind, the cover can be closed very easily without the need to dismantle the structure.

4 Claims, 6 Drawing Sheets

COVERED STRUCTURE WITH AN EXPANDABLE/CLOSEABLE EXTERIOR

This application claims priority to Chinese Patent Application No. 200520039768.6, filed Feb. 24, 2005, which is hereby incorporated by reference.

FIELD OF INVENTION

This invention relates generally to covered structures, and in particular to structures with an expandable exterior.

BACKGROUND OF INVENTION

Numerous covered leisure structures, such as gazebos, comprise poles, crossbeams, and roof frames, and these structures mostly can be dismantled. If the structure will not be used for a long period or there is strong wind, the structure will have to be dismantled entirely and assembled again when in need. This is time consuming and labor taxing.

SUMMARY OF INVENTION

A structure with a retractable cover comprising a plurality of poles, each of said poles having a top end and a bottom end; a plurality of crossbeams joined to said plurality of poles; a plurality of roof rods, each of said roof rods having a first end and a second end; a winding device; a pull cord; a pulley block; and a collapsible frame comprising a cover, wherein said first end of each of said roof rods is joined to and contiguous to said top end of one of said poles, all of said second ends of said roof rods are contiguous to one another and joined to one another at an apex, one of said roof rods is a first roof rod having an open channel in a longitudinal direction of said first roof rod, said pulley block is slideably mounted in said open channel, said collapsible frame is joined to said pulley block, said winding device is joined to said pole to which said first roof rod is connected, and said pull cord connects said winding device with said collapsible frame through said pulley block, and wherein operation of said winding device in one direction results in extension of said collapsible frame and said cover and in movement of said pulley block in said open channel in a direction towards said apex, and wherein operation of said winding device in an opposite direction results in retraction of said collapsible frame and said cover and in movement of said pulley block in said open channel in a direction towards said pole to which said first roof rod is connected.

DETAILED DESCRIPTION OF PREFERRED EMBODIMENTS

The present invention is intended to provide a covered structure (such as a gazebo or awning, for example) with a closeable exterior without dismantling of the structure.

Figure 1:
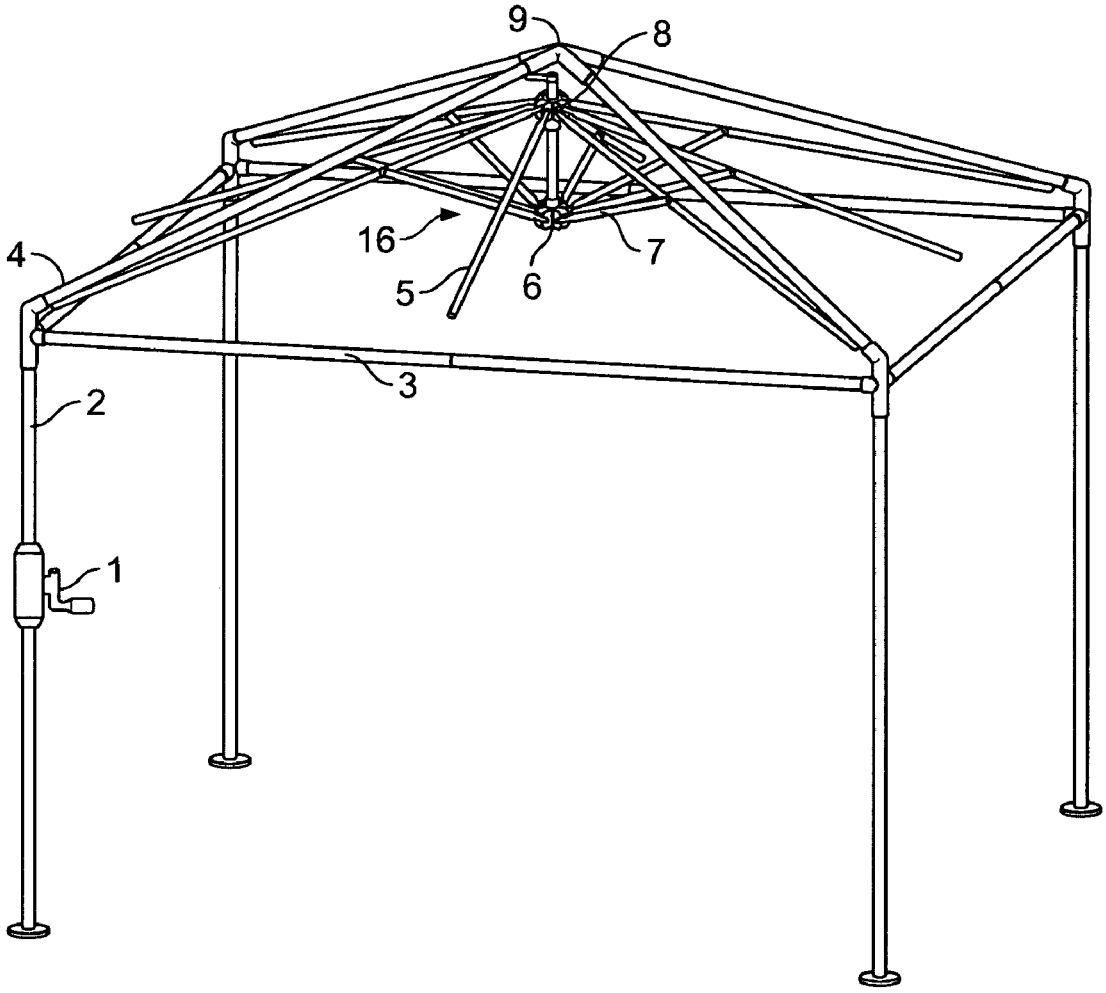
FIG. 1 is a diagram of an embodiment of an open hanging umbrella gazebo (quadrate roof).
Figure 2:
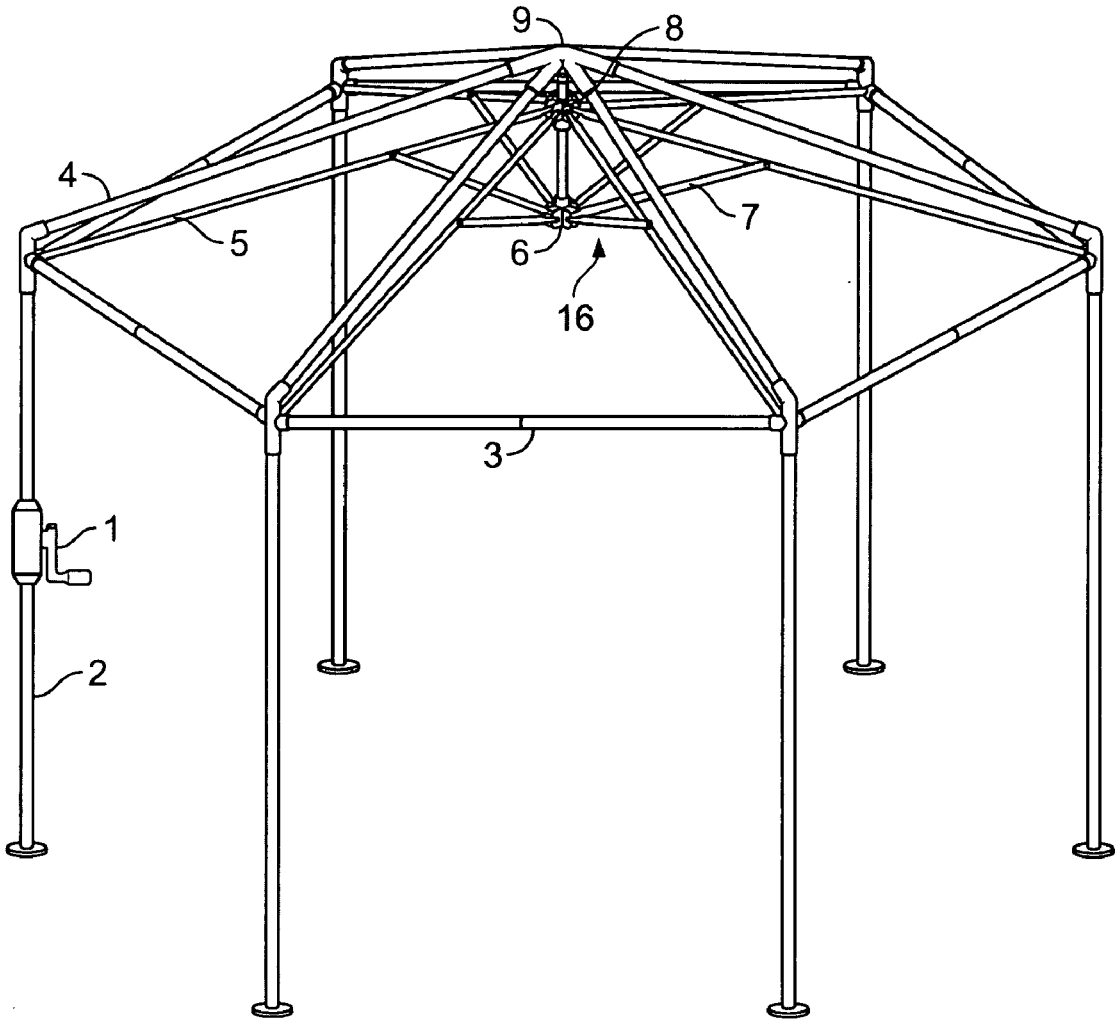
FIG. 2 is a diagram of an embodiment of an open hanging umbrella gazebo (hexagonal roof).

Particularly preferred structures are gazebos, such as those shown in FIGS. 1-4. As shown in FIGS. 1-2, preferably, the gazebo may be either quadrate (FIG. 1) or hexagonal (FIG. 2).

Figure 4:
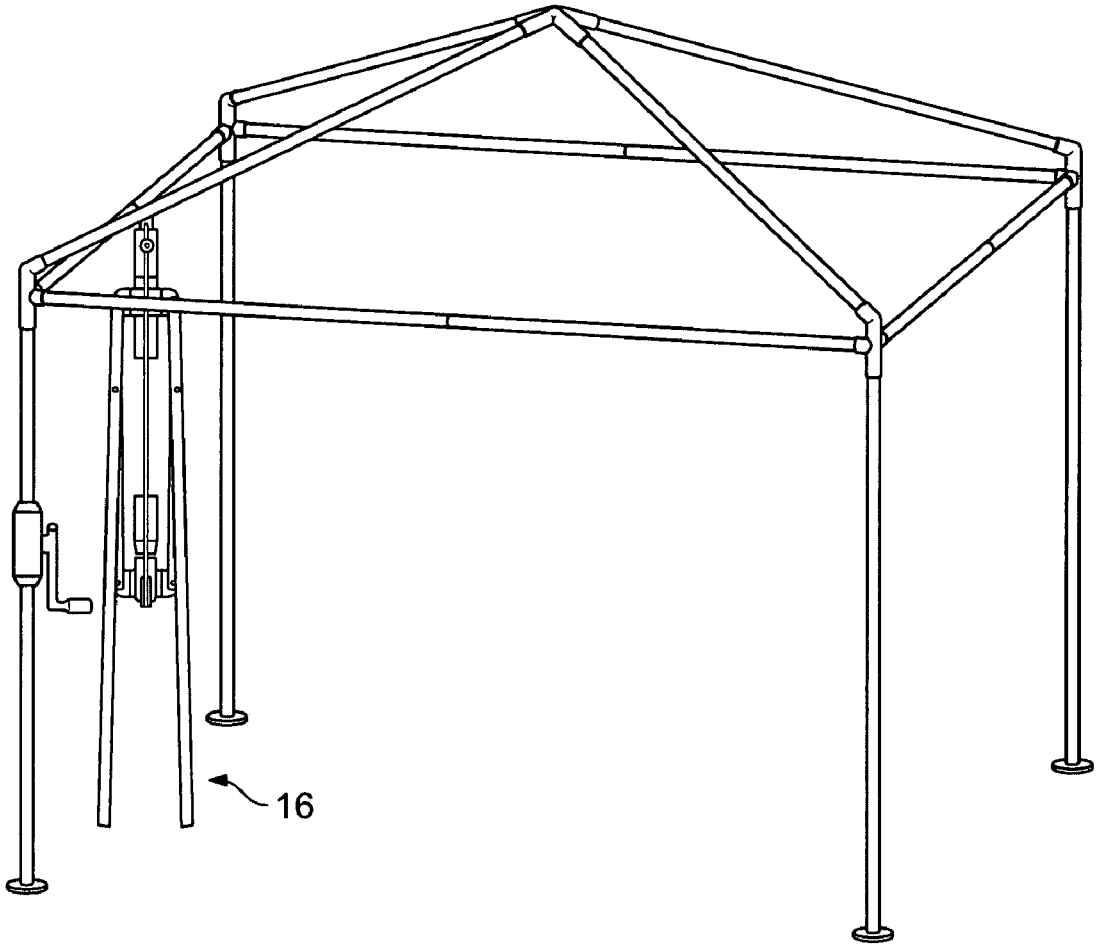
FIG. 4 is a diagram of an embodiment of a hanging umbrella gazebo that has already closed.
Figure 5:
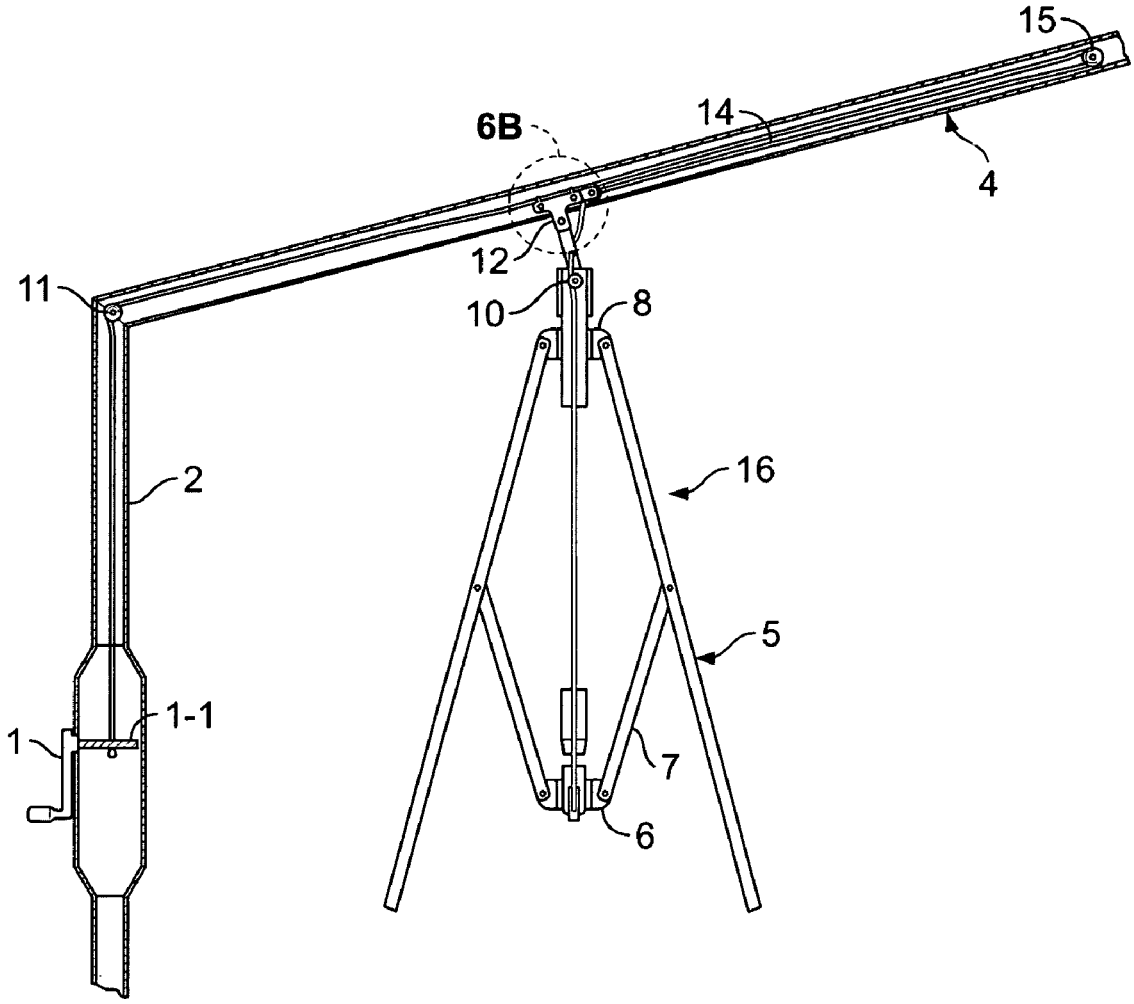
FIG. 5 is a diagram of an embodiment of a pull cord controlling system of a hanging umbrella gazebo.

In one preferred embodiment, referring to FIG. 1 or 2, typically, a plurality of poles 2 are connected with a plurality of crossbeams 3. A plurality of roof rods 4 are connected with a joint 9 to form an apex, and function as a roof frame. One of the poles has a winding device 1 (for example, a crank). A collapsible frame comprising a cover (not shown) is typically an "umbrella" frame, such as frame 16 as shown in FIGS. 1-5, but may also be any structure capable of opening and closing and serving as a support for the cover. Referring to FIGS. 1, 2, and/or 5, umbrella frame 16 has ribs 5, short ribs 7, upper hub 8, and nether hub 6. The ribs 5 join with the upper hub 8. Each short rib 7 on one end joins with a rib 5 and on the other end joins with nether hub 6. Frame 16 is joined with pulley block 12, as shown in FIG. 5. Frame 16 is the framework by which a cover is supported.

Figure 6A:
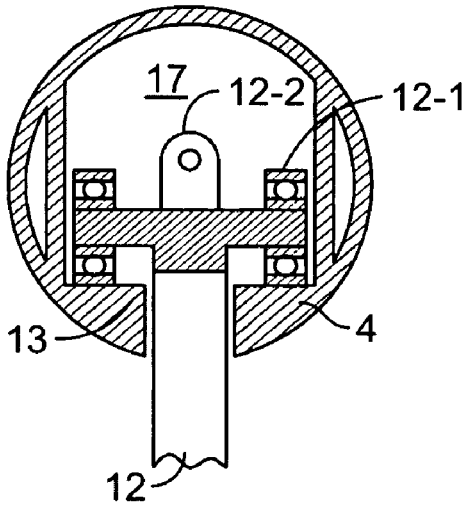
FIG. 6 is a diagram of the amplified cross and vertical section of the part "12" in FIG. 5.
Figure 6B:
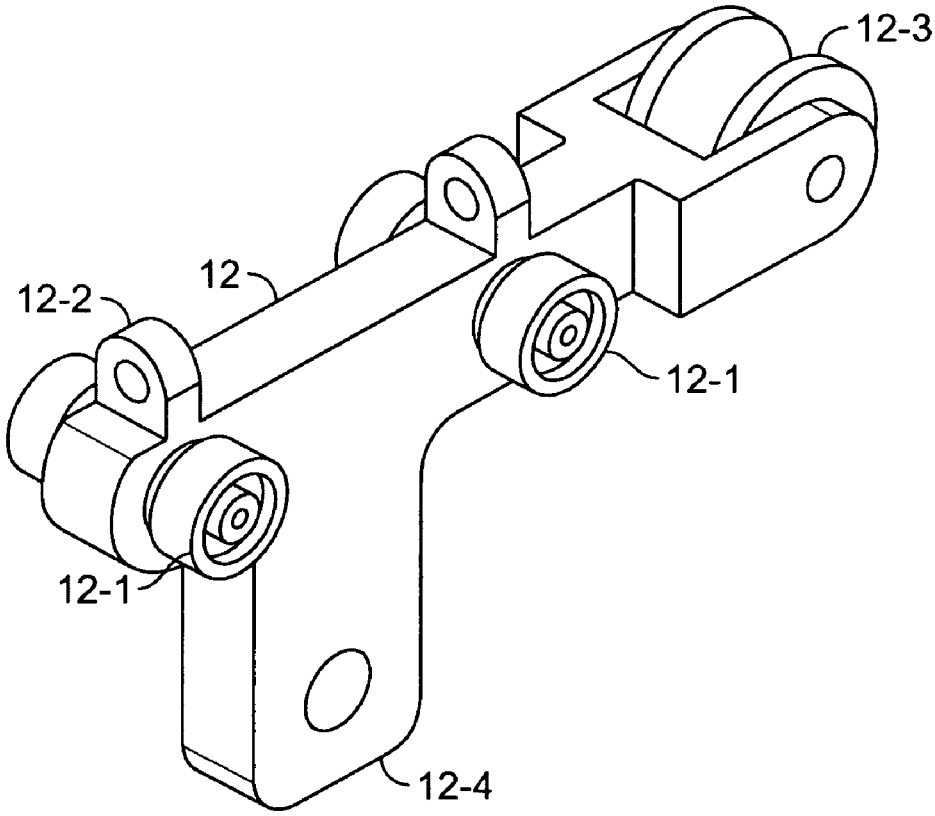

As shown in FIGS. 5 and 6, one of the roof rods 4 has an open channel 17 running along the length of the roof rod (i.e., in longitudinal direction of the roof rod) into which a moveable pulley block may be slideably mounted or connected. The moveable pulley block may employ any known structure or technique to enable the pulley block to slideably move along open channel 17 or along roof rod 4. FIGS. 5 and 6 show a preferred pulley block 12 that can be slideably mounted in open channel 17. Pulley block 12 has a set of rollers (or wheels) 12-1 engaged along guide rails 13 formed in open channel 17. The base 12-4 of the pulley block 12 is joined with frame 16. As also shown in FIG. 5, the roof rod having the open channel 17 is joined to the pole 2 with winding device 1.

A plurality of pulleys (or spools or crown blocks) are located along a path running from winding device 1 along the pole 2, the roof rod 4, to frame 16, for example, as shown in FIG. 5, there are pulleys 11, 15, and 10.

Referring to FIGS. 5 and 6, a pull cord 14 (for example, a rope or cable) on one end is connected to scroll 1-1 inside of winding device 1, and runs through (but may also run along the outside of) the pole to which the winding device 1 is joined, around pulley 11, through holes 12-2, around pulley 15, around pulley 12-3, along pulley 10, and then finally ends, with the other end of the pull cord connected to nether hub 6 of frame 16.

Figure 3:
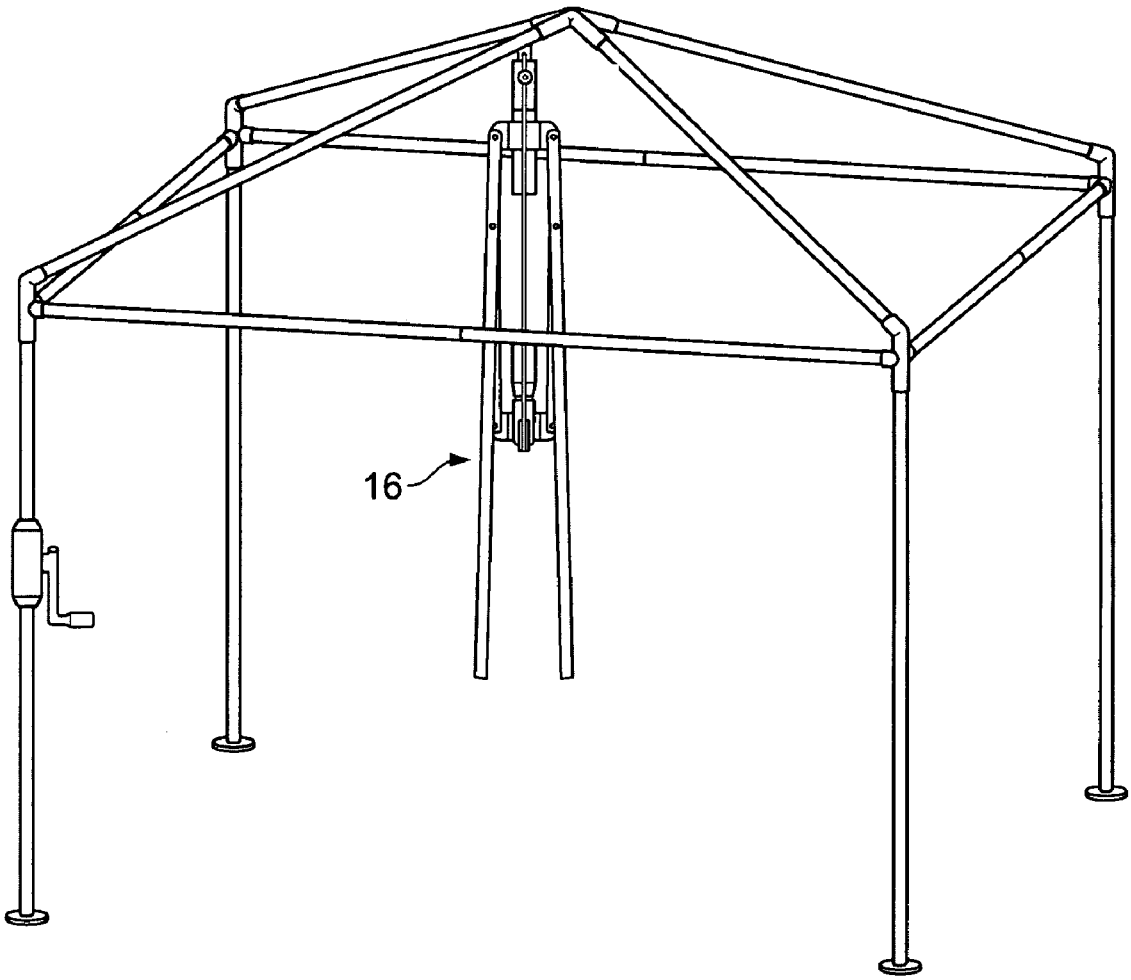
FIG. 3 is a diagram of an embodiment of a hanging umbrella gazebo that begins to close.

When winding device 1 is operated in one direction (to release more length of the pull cord), this results in nether hub 6 moving downward away from upper hub 8, thereby retracting short ribs 7 and ribs 5 and collapsing the frame 16 and its cover, as shown in FIG. 3. If the pull cord is further released, pulley block 12 will move down along the rail 13 to the bottom of the roof rib 4, along with the collapsed frame 16 with closed cover connected thereto, by the function of gravity, as shown in FIG. 4. When winding device 1 is operated in the opposite direction, pulley block 12 will move along rail 13 towards the apex of joint 9, thereby extending and opening the frame 16 and its cover.

What is claimed:

1. A structure with a retractable cover comprising:

a plurality of poles, each of said poles having a top end and a bottom end;

a plurality of crossbeams joined to said plurality of poles;

a plurality of roof rods, each of said roof rods having a first end and a second end;

a winding device;

a pull cord;

a pulley block; and a collapsible frame comprising a cover, wherein said first end of each of said roof rods is joined to and contiguous to said top end of one of said poles, all of said second ends of said roof rods are contiguous to one another and joined to one another at an apex, one of said roof rods is a first roof rod having an open channel in a longitudinal direction of said first roof rod, said pulley block is slideably mounted in said open channel, said collapsible frame is joined to said pulley block, said winding device is joined to said pole to which said first roof rod is joined, and said pull cord connects said winding device with said collapsible frame through said pulley block, and wherein operation of said winding device in one direction results in extension of said collapsible frame and said cover and in movement of said pulley block in said open channel in a direction towards said apex, and wherein operation of said winding device in an opposite direction results in retraction of said collapsible frame and said cover and in movement of said pulley block in said open channel in a direction towards said pole to which said first roof rod is joined.

2. The structure of claim 1, further comprising a pair of guide rails disposed within said open channel in said longitudinal direction of said first roof rod, wherein said pulley block further comprises rollers and said pulley block is slideably mounted in said open channel by engaging said rollers along said pair of guide rails.

3. The structure of claim 1, further comprising:

a plurality of pulleys joined to said pole to which said first roof rod is joined, said first roof rod, and said collapsible frame, wherein said pull cord connects said winding device with said collapsible frame through said plurality of pulleys and said pulley block.

4. The structure of claim 1, wherein said collapsible frame is an umbrella frame.

* * * * *